US010746005B2

(12) United States Patent
Al-Buraik

(10) Patent No.: US 10,746,005 B2
(45) **Date of Patent: *Aug. 18, 2020**

(54) FORMATION FRACTURING USING HEAT TREATMENT

(71) Applicant: Saudi Arabian Oil Company, Dhahran (SA)

(72) Inventor: Khaled A. Al-Buraik, Doha (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/164,358

(22) Filed: Oct. 18, 2018

(65) Prior Publication Data

US 2019/0048697 A1 Feb. 14, 2019

Related U.S. Application Data

(63) Continuation of application No. 14/715,149, filed on May 18, 2015, now Pat. No. 10,113,402.

(51) Int. Cl.

| | |
|---|---|
| ***E21B 43/24*** | (2006.01) |
| ***E21B 36/00*** | (2006.01) |
| ***E21B 43/26*** | (2006.01) |
| ***E21B 47/07*** | (2012.01) |

(52) U.S. Cl.

CPC ..... *E21B 43/2405* (2013.01); *E21B 36/00* (2013.01); *E21B 43/26* (2013.01); *E21B 47/07* (2020.05)

(58) Field of Classification Search

CPC . E21B 36/00; E21B 43/24; E21B 7/00; E21B 47/065; E21B 43/2405

See application file for complete search history.

(56) References Cited

U.S. PATENT DOCUMENTS

| | | | |
|---|---|---|---|
| 4,067,390 | A | 1/1978 | Camacho et al. |
| 4,083,604 | A | 4/1978 | Bohn |
| 4,090,572 | A | 5/1978 | Welch |
| 4,140,180 | A | 2/1979 | Bridges |

(Continued)

FOREIGN PATENT DOCUMENTS

| | | |
|---|---|---|
| GB | 2515547 | 12/2014 |
| WO | 9506093 | 3/1995 |

(Continued)

OTHER PUBLICATIONS

PCT International Search Report and Written Opinion of the International Searching Authority, PCT/US2015/059216, dated Apr. 7, 2016, 13 pages.

(Continued)

*Primary Examiner* — Robert E Fuller

(74) *Attorney, Agent, or Firm* — Fish & Richardson P.C.

(57) ABSTRACT

A downhole tool system includes a downhole tool string configured to couple to a downhole conveyance that extends in a wellbore from a terranean surface through at least a portion of a subterranean zone, the subterranean zone including a geologic formation; and a heating device coupled with the downhole tool string, the heating device configured to transfer heat to the geologic formation in the wellbore at a specified temperature sufficient to adjust a quality of the geologic formation associated with a rock strength of the geologic formation.

20 Claims, 4 Drawing Sheets

(56) References Cited

U.S. PATENT DOCUMENTS

| | | | | |
|---|---|---|---|---|
| 4,148,359 | A | 4/1979 | Laumbach | |
| 4,265,310 | A | 5/1981 | Britton | |
| 4,401,163 | A | 8/1983 | Elkins | |
| 4,485,869 | A | 12/1984 | Sresty | |
| 4,487,260 | A | 12/1984 | Pittman | |
| 4,705,108 | A | 11/1987 | Little | |
| 4,793,716 | A | 12/1988 | Wei | |
| 4,895,206 | A | 1/1990 | Price | |
| 5,361,845 | A | 11/1994 | Jamaluddin | |
| 5,980,103 | A | 11/1999 | Ikuno | |
| 7,331,385 | B2 | 2/2008 | Symington | |
| 7,441,603 | B2 | 10/2008 | Kaminsky | |
| 7,559,251 | B2 | 7/2009 | Lee | |
| 7,740,069 | B2 | 6/2010 | Young | |
| 7,857,056 | B2 | 12/2010 | Kaminsky | |
| 8,104,537 | B2 | 1/2012 | Kaminsky | |
| 8,308,352 | B1 | 11/2012 | Waldrop | |
| 2004/0129414 | A1* | 7/2004 | Kriesels | E21B 7/068 166/50 |
| 2007/0137852 | A1 | 6/2007 | Considine | |
| 2008/0296017 | A1 | 12/2008 | Sonne | |
| 2009/0145598 | A1 | 6/2009 | Symington et al. | |
| 2010/0264915 | A1* | 10/2010 | Saldungaray | E21B 43/16 324/303 |
| 2014/0041940 | A1 | 2/2014 | Shnell | |

FOREIGN PATENT DOCUMENTS

| | | |
|---|---|---|
| WO | 9603566 | 2/1996 |
| WO | 2009073475 | 6/2009 |
| WO | 2009129143 | 10/2009 |

OTHER PUBLICATIONS

Gulf Cooperation Council Examination Report issued in GCC Application No. GC 2016-31039 dated May 15, 2018, 4 pages.
Communication Pursuant to Article 94(3) EPC issued in European Application No. 15794776.3 dated Jul. 18, 2019, 8 pages.
Sygala et al., "High Temperature Versus Geomechanical Parameters of Selected Rocks—The Present State of Research," Journal of Sustainable Mining, vol. 12, No. 4, Jan. 24, 2014, 7 pages.
Gulf Cooperation Council Examination Report issued in GCC Application No. GC 2016-31039 dated Nov. 8, 2018, 4 pages.
Communication Pursuant to Article 94(3) EPC issued in European Application No. 15794776.3 dated Nov. 30, 2018, 7 pages.

* cited by examiner

FORMATION FRACTURING USING HEAT TREATMENT

TECHNICAL FIELD

This application is a continuation application of and claims the benefit of priority to 35 U.S.C. § 120 to U.S. patent application Ser. No. 14/715,149, filed on May 18, 2015, the contents of which are hereby incorporated by reference.

TECHNICAL FIELD

This disclosure relates to fracturing a geological formation using a heat treatment.

BACKGROUND

In some instances, a geologic formation, such as shale, may be fractured to initiate or enhance hydrocarbon production from the formation. Fracturing typically involves pumping a fluid into a wellbore at a particular pressure to break, or "fracture," the geologic formation. The hydrocarbon fluid may then flow through the fractures and cracks generated by the fracturing process to the wellbore, and ultimately to the surface. In some instances, the fracturing process includes multiple stages of high-pressure fluid circulation into the wellbore, which may involve increased costs and complexities.

SUMMARY

This disclosure describes implementations of a wellbore system that includes a downhole heating assembly. In some aspects, the downhole heating assembly may be controlled to apply or focus heat to a portion of a rock formation that defines a wellbore. In some aspects, the focused heat may be applied (for example, along with a drilling operation or subsequent to a drilling operation) at a specified temperature sufficient to reduce a capability of the rock formation to absorb a liquid, such as a drilling fluid, water, or other liquid. In some aspects, the focused heat may be applied (for example, prior to a hydraulic fracturing operation) at a specified temperature sufficient to weaken the rock formation, fracture the rock formation, or both.

In an example implementation, a downhole tool system includes a downhole tool string configured to couple to a downhole conveyance that extends in a wellbore from a terranean surface through at least a portion of a subterranean zone, the subterranean zone including a geologic formation; and a heating device coupled with the downhole tool string, the heating device configured to transfer heat to the geologic formation in the wellbore at a specified temperature sufficient to adjust a quality of the geologic formation associated with a rock strength of the geologic formation.

In a first aspect combinable with the example implementation, the quality of the geologic formation associated with the rock strength of the geologic formation includes a static Young's modulus of the geologic formation.

In a second aspect combinable with any one of the previous aspects, the specified temperature is sufficient to reduce the static Young's modulus of the geologic formation.

In a third aspect combinable with any one of the previous aspects, the geologic formation includes a shale formation.

In a fourth aspect combinable with any one of the previous aspects, the specified temperature is between 400° C. and 500° C.

In a fifth aspect combinable with any one of the previous aspects, the heating device includes at least one of a microwave heating device, a laser heating device, or an in situ combustor.

A sixth aspect combinable with any one of the previous aspects further includes a temperature sensor positioned adjacent the heating device; and a control system configured to receive a temperature value from the temperature sensor and adjust the heating device based, at least in part, on the received temperature value.

In a seventh aspect combinable with any one of the previous aspects, the heating device is configured to focus the heat on a portion of the geologic formation in the wellbore.

In an eighth aspect combinable with any one of the previous aspects, the specified temperature is sufficient to generate one or more fractures in the geologic formation.

In another example implementation, a method for treating a geologic formation includes positioning, in a wellbore, a downhole heating device that is coupled to a downhole conveyance that extends from a terranean surface to a subterranean zone that includes a geologic formation; generating, with the downhole heating device, an amount of heat power at a specified temperature to transfer to a portion of the geologic formation in the wellbore; and adjusting a quality of the geologic formation associated with a rock strength of the geologic formation based on the generated amount of heat power at the specified temperature.

In a first aspect combinable with the example implementation, the quality of the geologic formation associated with the rock strength of the geologic formation includes a static Young's modulus of the geologic formation.

In a second aspect combinable with any one of the previous aspects, the specified temperature is sufficient to reduce the static Young's modulus of the geologic formation.

In a third aspect combinable with any one of the previous aspects, generating, with the downhole heating device, an amount of heat power at a specified temperature to transfer to a portion of the geologic formation includes at least one of: activating a downhole laser to generate the amount of heat power at the specified temperature to transfer to the portion of the geologic formation; activating a downhole microwave to generate the amount of heat power at the specified temperature to transfer to the portion of the geologic formation; or activating a downhole combustor to generate the amount of heat power at the specified temperature to transfer to the portion of the geologic formation.

A fourth aspect combinable with any one of the previous aspects further includes focusing the generated heat power on a portion of the geologic formation in the wellbore.

A fifth aspect combinable with any one of the previous aspects further includes generating one or more fractures in the geologic formation based on the generated amount of heat power at the specified temperature.

A sixth aspect combinable with any one of the previous aspects further includes performing a hydraulic fracturing operation subsequently to adjusting the quality of the geologic formation associated with the rock strength of the geologic formation.

A seventh aspect combinable with any one of the previous aspects further includes measuring a temperature in the wellbore adjacent the portion of the geologic formation during generation of the heat power; comparing the measured temperature and the specified temperature; and based on a difference in the measured temperature and the specified temperature, adjusting the downhole heating device.

An eighth aspect combinable with any one of the previous aspects further includes determining the specified temperature based, at least in part, on one or more of a property of a drilling fluid used to form the wellbore; a mineral property of the geologic formation; or a physical property of the geologic formation.

In a ninth aspect combinable with any one of the previous aspects, the geologic formation includes a shale formation.

In another example implementation, a downhole tool includes a top sub-assembly configured to couple to a downhole conveyance; a housing connected to the top sub-assembly; and a heater enclosed within at least a portion of the housing and configured to transfer heat to a rock formation in the wellbore at a specified temperature sufficient generate one or more fractures in the rock formation.

In a first aspect combinable with the example implementation, the heater is configured to transfer heat to the rock formation in the wellbore at the specified temperature sufficient to reduce a static Young's modulus of the rock formation.

In a second aspect combinable with any one of the previous aspects, the specified temperature is between 400° C. and 500° C.

In a third aspect combinable with any one of the previous aspects, the heating device includes at least one of a microwave heating device, a laser heating device, or an in situ combustor.

A fourth aspect combinable with any one of the previous aspects further includes a bottom sub-assembly configured to couple to a hydraulic fracturing tool.

Implementations of a wellbore system according to the present disclosure may further include one or more of the following features. For example, the wellbore system may treat (for example, with heat) a geological formation through which a wellbore is formed in order to generate cracks or fractures in the geologic formation. In some examples, the heat treatment may weaken the geologic formation to increase an efficiency or ease of further fracturing the formation with a hydraulic fracturing operation. As yet another example, the well system may treat (for example, with heat) a geological formation to initiate a chemical change in the formation that increases an efficiency or ease of further fracturing the formation with a hydraulic fracturing operation. As yet another example, the well system may treat (for example, with heat) the geologic formation to decrease a number of stages in a subsequent multi-stage hydraulic fracturing operation.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1A:
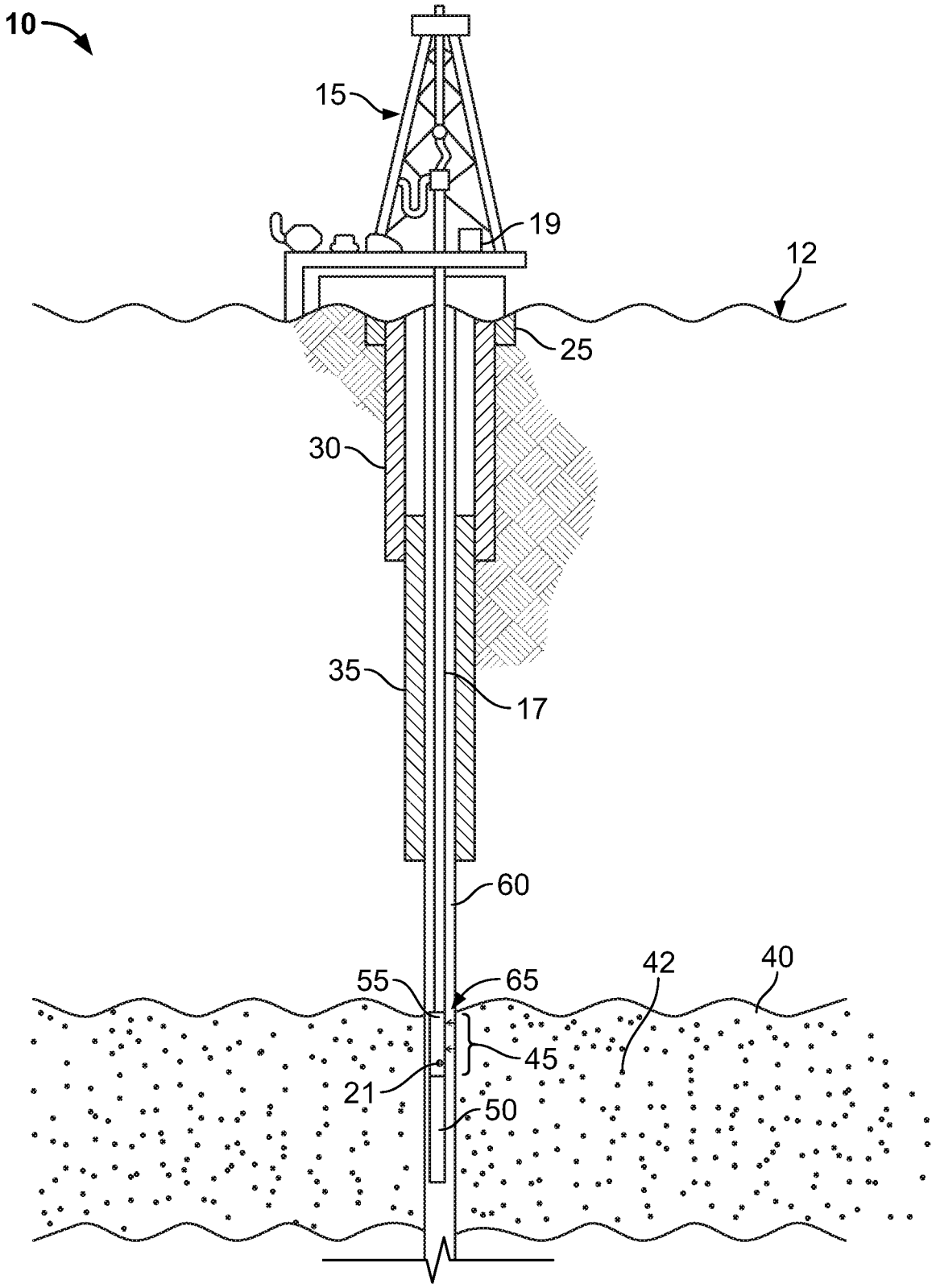
FIG. 1A is a schematic diagram of an example wellbore system that includes a downhole heat source.

FIG. 1A is a schematic diagram of an example wellbore system 100 including a downhole heater. Generally, FIG. 1A illustrates a portion of one embodiment of a wellbore system 10 according to the present disclosure in which a heating device, such as a downhole heater 55, may generate heat and apply or focus the generated heat on rock formation 42 of a subterranean zone 40. The generated heat, in some implementations, may blister or weaken the rock formation 42, making the formation 42 more susceptible to fracturing, for example, hydraulic fracturing. For instance, exposure of the rock formation 42 to the generated heat may reduce or affect a measure of rock strength of the rock formation 42, as well as, in some cases, create fractures in the rock formation 42. The weakened or fractured rock formation 42 may subsequently be more easily fractured, for example, hydraulically, in a full fracturing operation.

As shown, the wellbore system 10 accesses a subterranean formations 40, and provides access to hydrocarbons located in such subterranean formation 40. In an example implementation of system 10, the system 10 may also be used for a completion, for example, hydraulic fracturing, operation in which the downhole tool 50 may include or be coupled with a hydraulic fracturing tool. Thus, the wellbore system 10 may allow for a drilling or fracturing or stimulation operations.

As illustrated in FIG. 1A, an implementation of the wellbore system 10 includes a drilling assembly 15 deployed on a terranean surface 12. The drilling assembly 15 may be used to form a wellbore 20 extending from the terranean surface 12 and through one or more geological formations in the Earth. One or more subterranean formations, such as subterranean zone 40, are located under the terranean surface 12. As will be explained in more detail below, one or more wellbore casings, such as a surface casing 30 and intermediate casing 35, may be installed in at least a portion of the wellbore 20.

In some embodiments, the drilling assembly 15 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

Generally, as a drilling system, the drilling assembly 15 may be any appropriate assembly or drilling rig used to form wellbores or boreholes in the Earth. The drilling assembly 15 may use traditional techniques to form such wellbores, such as the wellbore 20, or may use nontraditional or novel techniques. In some embodiments, the drilling assembly 15 may use rotary drilling equipment to form such wellbores. Rotary drilling equipment is known and may consist of a drill string 17 (also shown in FIG. 1B as reference 117) and the downhole tool 50 (for example, a bottom hole assembly and bit). In some embodiments, the drilling assembly 15 may consist of a rotary drilling rig. Rotating equipment on such a rotary drilling rig may consist of components that serve to rotate a drill bit, which in turn forms a wellbore, such as the wellbore 20, deeper and deeper into the ground. Rotating equipment consists of a number of components (not all shown here), which contribute to transferring power from a prime mover to the drill bit itself. The prime mover supplies power to a rotary table, or top direct drive system, which in turn supplies rotational power to the drill string 17. The drill string 17 is typically attached to the drill bit within the downhole tool 50 (for example, bottom hole assembly). A swivel, which is attached to hoisting equipment, carries much, if not all of, the weight of the drill string 17, but may allow it to rotate freely.

The drill string 17 typically consists of sections of heavy steel pipe, which are threaded so that they can interlock together. Below the drill pipe are one or more drill collars, which are heavier, thicker, and stronger than the drill pipe. The threaded drill collars help to add weight to the drill string 17 above the drill bit to ensure that there is enough downward pressure on the drill bit to allow the bit to drill through the one or more geological formations. The number and nature of the drill collars on any particular rotary rig may be altered depending on the downhole conditions experienced while drilling.

Figure 1B:
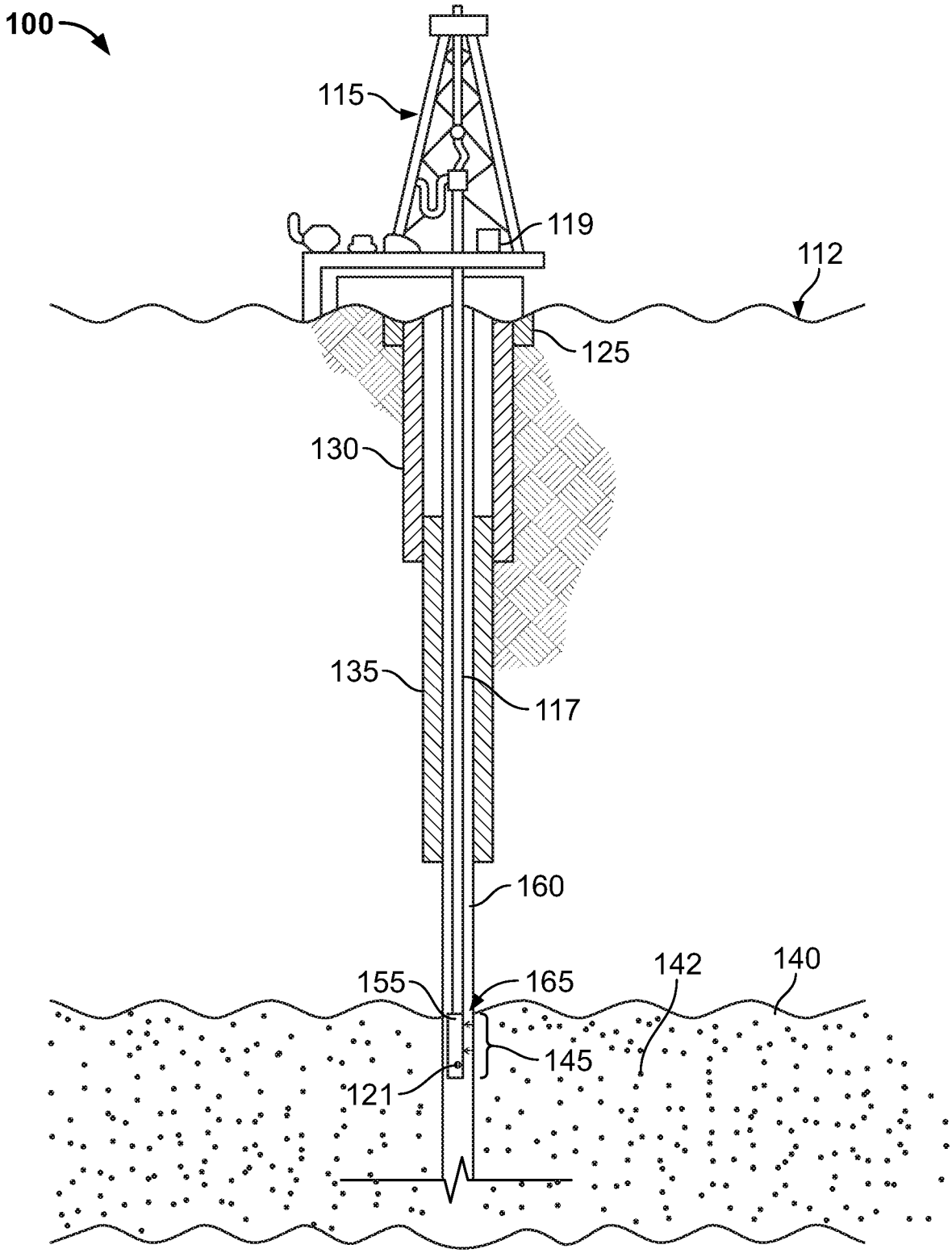
FIG. 1B is a schematic diagram of another example wellbore system that includes a downhole heat source.

The circulating system of a rotary drilling operation, such as the drilling assembly 15, may be an additional component of the drilling assembly 15. Generally, the circulating system may cool and lubricate the drill bit, removing the cuttings from the drill bit and the wellbore 20 (for example, through an annulus 60, which is also shown in FIG. 1B as reference 160), and coat the walls of the wellbore 20 with a mud type cake. The circulating system consists of drilling fluid, which is circulated down through the wellbore throughout the drilling process. Typically, the components of the circulating system include drilling fluid pumps, compressors, related plumbing fixtures, and specialty injectors for the addition of additives to the drilling fluid. In some embodiments, such as, for example, during a horizontal or directional drilling process, downhole motors may be used in conjunction with or in the downhole tool 50. Such a downhole motor may be a mud motor with a turbine arrangement, or a progressive cavity arrangement, such as a Moineau motor. These motors receive the drilling fluid through the drill string 17 and rotate to drive the drill bit or change directions in the drilling operation.

In some embodiments of the wellbore system 10, the wellbore 20 may be cased with one or more casings. As illustrated, the wellbore 20 includes a conductor casing 25 (also shown in FIG. 1B as reference 125), which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the intermediate casing 35.

In another implementation of the wellbore system 10, the rig 15 may be a completion or workover rig capable of implementing a hydraulic fracturing operation. For example, the rig 15 may include or be associated with a hydraulic fracturing system that includes, for example, a fracturing fluid source (for example, gel, liquid, or otherwise), a liquid additive (for example, water or other liquid) for the fracturing fluid source, a solids additive (for example, proppant), mixing tanks, blenders, and pumps. In some aspects, the hydraulic fracturing system may be associated with or mounted on the rig 15. In some alternative aspects, the hydraulic fracturing system may be a mobile system, for example, mounted on trucks or other mobile conveyances.

In an example operation, hydraulic fracturing fluid may be circulated through the tubing string 17 and to the downhole tool 50, where the fluid may be pumped (for example, at high pressure) into the subterranean zone 40 to fracture or crack the rock formation 42, thereby increasing hydrocarbon production, initiating hydrocarbon production, or both. The hydraulic fracturing fluid may then be circulated back to the terranean surface 12, for example, through the annulus 60.

As shown, the downhole heater 55 is positioned adjacent the downhole tool 50, for example, coupled to, coupled within a common tool string, or otherwise. Thus, the implementation of the well system 10 shown in FIG. 1A includes the downhole heater 55 as part of an additional downhole tool string or downhole tool 50. In some instances, the downhole tool string may be used for a drilling operation as described. In some instances, the downhole tool string may be used for a completion operation, for example, a hydraulic fracturing operation. In any event, the downhole heater 55 may be positioned to generate heat 65 to apply or focus to a portion 45 of the wellbore 20 adjacent the rock formation 42.

The downhole heater 55 may be or include at least one heating source, such as a laser heating source, a microwave heating source, or in situ combustion heating source. In some implementations, such as with an in situ combustion heating source, a combustion fuel and oxygen may be circulated (not shown) down the wellbore 20 to the downhole heater 55. In some implementations, the downhole heater 55 may generate the heat 65 without a heating source from the terranean surface 12. As illustrated, the downhole heater 55 may focus the heat 65 on to or at a particular portion 45 of the rock formation 42 that forms the wellbore 20 (for example, an uncased portion). In some aspects, the downhole heater 55 may simultaneously focus the heat 65 on all portions of the surrounding wellbore 20 (for example, in a 360° radial direction). In some aspects, the downhole heater 55 may rotate or move to focus the heat 65 on several different portions of the wellbore 20.

The downhole heater 55 may also generate the heat 65 to apply to the rock formation 42 to reduce a hardness or strength of the rock formation 42 (for example, reduce the capability of the rock formation 42 to withstand fracturing) between about 400° C. and about 500° C. For example, the downhole heater 55 may focus the generated heat 65 to blister or weaken the rock formation 42, thereby weakening the rock formation 42 for subsequent fracturing, for example, hydraulic. In some aspects, the heat 65 generated by the downhole heater 55 and applied to the rock formation 42 may create fractures in the rock formation 42. In some aspects, the heat 65 may be generated at a sufficient temperature (for example, 400° C. to 500° C. or higher) for a sufficient duration (for example, second or minutes, thirty minutes, an hour, longer than an hour) to affect the rock formation 42 to reduce a static Young's modulus of the rock formation 42, or other strength or hardness characteristic of the rock formation 42. In some aspects, for instance, a longer duration of heat 65 applied to the rock formation 42 may reduce the static Young's modulus of the rock formation 42 more than a shorter duration of the heat 65. For example, in some aspects, the application of heat 65 to the rock formation 42 may initially increase the static Young's modulus, but subsequently, continued heat 65 may then reduce the static Young's modulus of the rock formation 42 to a level in which the rock formation is sufficiently weakened or micro-fractured.

In some aspects, the rig 15 (or other portion of the well system 10) may include a control system 19, for example, microprocessor-based, electro-mechanical, or otherwise, that may control the downhole heater 55 based at least in part on a sensed temperature of the heat 65 (for example, sensed by one or more temperature sensors 21 in the wellbore). For example, the control system 19 (also shown in FIG. 1B as control system 119) may receive a continual or semi-continual stream of temperature data from the sensors 21 (also shown in FIG. 1B as sensors 121) and adjust the downhole heater 55 based on the temperature data. If the temperature data indicates that the heat 65 is at a temperature lower than a specified temperature, then the downhole heater 55 may be adjusted to output more heat 65. If the temperature data indicates that the heat 65 is at a temperature higher than a specified temperature, then the downhole heater 55 may be adjusted to output less heat 65. In some aspects, the control system 19 may control the downhole heater 55 to operate for a specified time duration.

FIG. 1B is a schematic diagram of another example wellbore system that includes a downhole heat source. Generally, FIG. 1B illustrates a portion of one embodiment of a wellbore system 100 according to the present disclosure in which a heating device, such as a downhole heater 155, may generate heat and apply or focus the generated heat on rock formation 142 of a subterranean zone 140. The generated heat, in some implementations, may blister or weaken the rock formation 142, making the formation 142 more susceptible to fracturing, for example, hydraulic fracturing. For instance, exposure of the rock formation 142 to the generated heat may reduce or affect a measure of rock strength of the rock formation 142, as well as, in some cases, create fractures in the rock formation 142. The weakened or fractured rock formation 142 may subsequently be more easily fractured, for example, hydraulically, in a full fracturing operation.

One or more subterranean formations, such as subterranean zone 140, are located under the terranean surface 112. Further, one or more wellbore casings, such as a surface casing 130 and intermediate casing 135, may be installed in at least a portion of the wellbore 120. In some embodiments, the rig 115 may be deployed on a body of water rather than the terranean surface 112. For instance, in some embodiments, the terranean surface 112 may be an ocean, gulf, sea, or any other body of water under which hydrocarbon-bearing formations may be found. In short, reference to the terranean surface 112 includes both land and water surfaces and contemplates forming and developing one or more wellbore systems 100 from either or both locations.

The downhole heater 155 may be or include at least one heating source, such as a laser heating source, a microwave heating source, or in situ combustion heating source. In some implementations, such as with an in situ combustion heating source, a combustion fuel and oxygen may be circulated (not shown) down the wellbore 120 to the downhole heater 155. In some implementations, the downhole heater 155 may generate the heat 165 without a heating source from the terranean surface 112. As illustrated, the downhole heater 155 may focus the heat 165 on to or at a particular portion 145 of the rock formation 142 that forms the wellbore 120 (for example, an uncased portion). In some aspects, the downhole heater 155 may simultaneously focus the heat 165 on all portions of the surrounding wellbore 120 (for example, in a 360° radial direction). In some aspects, the downhole heater 155 may rotate or move to focus the heat 165 on several different portions of the wellbore 120.

The downhole heater 155 may also generate the heat 165 to apply to the rock formation 142 to reduce a hardness or strength of the rock formation 142 (for example, reduce the capability of the rock formation 142 to withstand fracturing) between about 400° C. and about 500° C. For example, the downhole heater 155 may focus the generated heat 165 to blister or weaken the rock formation 142, thereby weakening the rock formation 142 for subsequent fracturing, for example, hydraulic. In some aspects, the heat 165 generated by the downhole heater 155 and applied to the rock formation 142 may create fractures in the rock formation 142. In some aspects, the heat 165 may be generated at a sufficient temperature (for example, 400° C. to 500° C. or higher) for a sufficient duration (for example, second or minutes, thirty minutes, an hour, longer than an hour) to affect the rock formation 142 to reduce a static Young's modulus of the rock formation 142, or other strength or hardness characteristic of the rock formation 142. In some aspects, for instance, a longer duration of heat 165 applied to the rock formation 142 may reduce the static Young's modulus of the rock formation 42 more than a shorter duration of the heat 65. For example, in some aspects, the application of heat 65 to the rock formation 142 may initially increase the static Young's modulus, but subsequently, continued heat 165 may then reduce the static Young's modulus of the rock formation 142 to a level in which the rock formation is sufficiently weakened or fractured.

Figure 2:
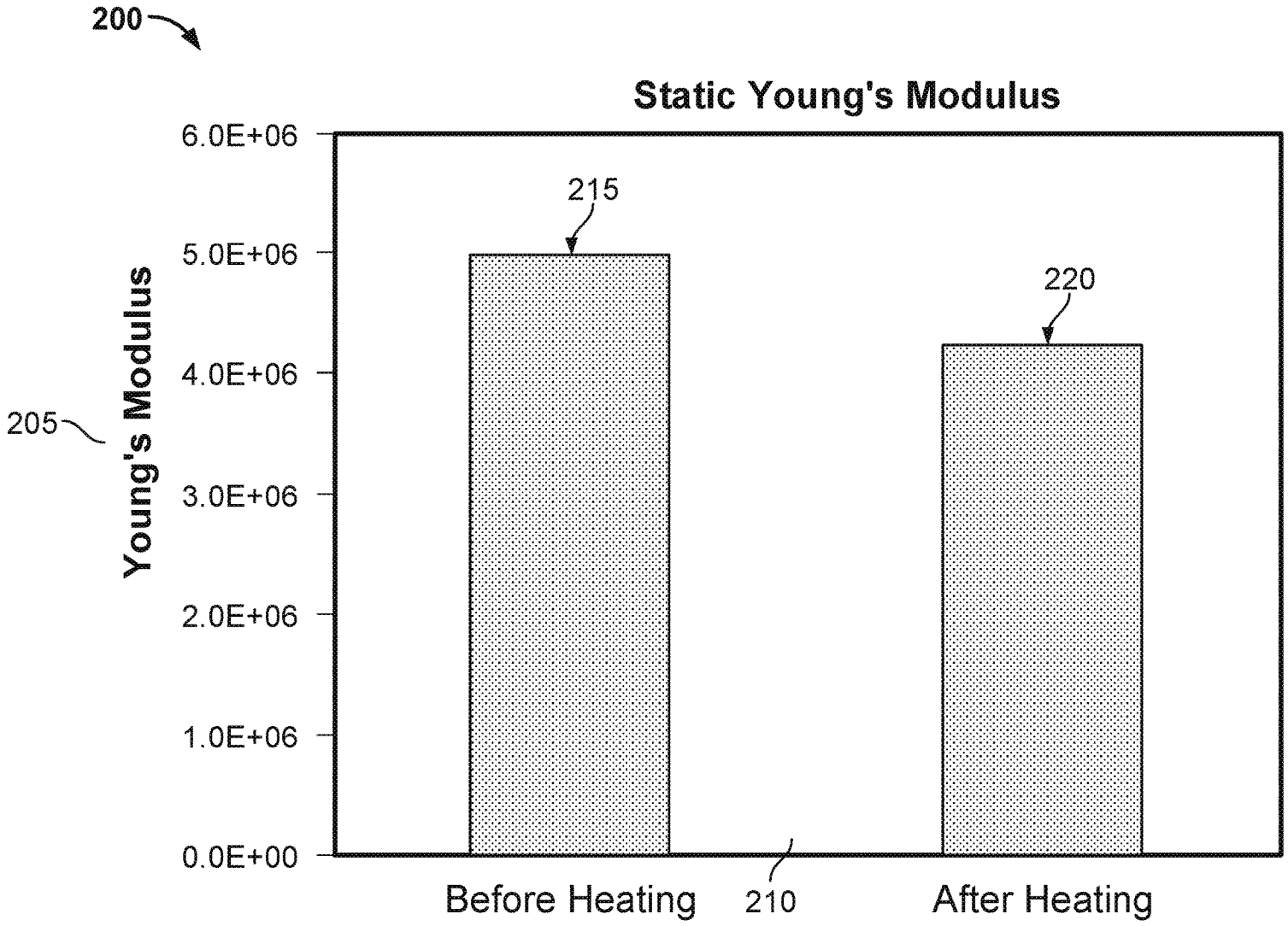
FIG. 2 is a graphical representation of another effect on a geological formation from a downhole heat source.

FIG. 2 is a graphical representation 200 of another effect on a geological formation from a downhole heat source. The graphical representation 200, generally, includes a y-axis 205 that represents a measure of stiffness of a rock sample, here static Young's modulus, and an x-axis 210 with rock samples 215 and 220. In this example, the rock samples 215 and 220 correspond to a shale sample. For example, the rock sample represents a Qusaiba shale sample. Table 1 shows the composition of the sample:

TABLE 1

| Compound | Percentage |
|---|---|
| Kaolinite-$Al_2Si_2O_5(OH)_4$ | 57.0 |
| Quartz-$SiO_2$ | 23.0 |
| Muscovite | 8.9 |
| MicroclineKAlSi$_3$O$_8$ | 3.8 |
| Goethite-FeOOH | 1.2 |
| Gibbsite-$Al(OH)_3$ | 0.7 |
| Illite + Mixed Layers I—S | 5.4 |

In this example sample, clay (for example, illite and kaolinite) made up more than 60% of the total rock sample. The mineralogical composition of clay fraction of the shale sample. The mixed layer clays (illite-smectite) content in the total clay is 15% with 70% smectite, which is a swelling clay, as shown in Table 2.

TABLE 2

| Element/Compound | Percentage |
|---|---|
| Illite | 6 |
| Illite-Smectite | 15 |

TABLE 2-continued

| Element/Compound | Percentage |
|---|---|
| Kaolinite | 79 |
| Clay Size | 25 |
| % of Smectite in Illite-Smectite | 70 |

The rock sample 215 represents the sample prior to heating, while the rock sample 220 represents the sample after heating (for example, at between 400-600° C.). Generally, Young's modulus is defined as a ratio of the stress along an axis to a strain along that axis, and is a measure of rigidity. In some aspects, a rock formation's Young's modulus may proximate its toughness, for example, resistivity to fracturing, as well.

As shown in FIG. 2, when not subjected to heating at a particular temperature, the rock sample 215 (unheated) exhibits a static Young's modulus of about $5\times10^6$ psi. Upon being subjected to heat at a particular temperature (for example, between about 400° C. and about 600° C.) however, the rock sample 220 (heated) exhibits a static Young's modulus of about $4.5\times10^6$ psi. Thus, by heating the rock sample 215 at a specified temperature (for example, greater than 500° C.) to blister the sample and change the structure, the rock sample 220 after heating may be more easily fractured (for example, hydraulically) and may exhibit the initiation of fractures.

Figure 3:
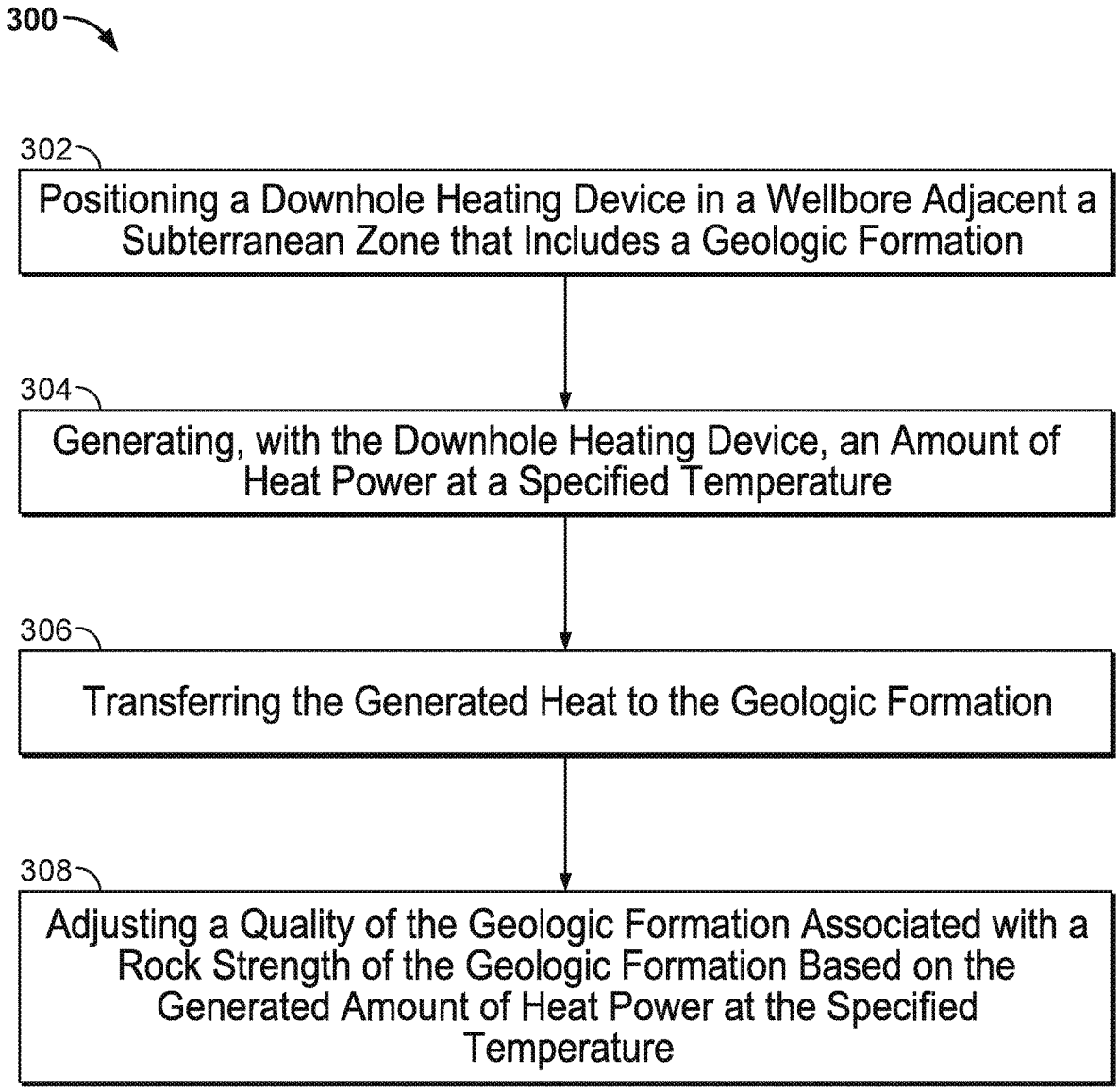
FIG. 3 is a flowchart that describes another example method performed with a wellbore system that includes a downhole heat source.

FIG. 3 is a flowchart that describes another example method 300 performed with a wellbore system that includes a downhole heat source. Method 300 may be performed with the well system 10, the well system 100, or other well system with a heating source according to the present disclosure. As described more fully below, method 300 may be implemented to weaken a rock formation or fracture a rock formation (or both), such as shale.

Method 300 may begin at step 302. Step 302 includes positioning a downhole heating device in a wellbore adjacent a subterranean zone that includes a geologic (for example, rock) formation. In some aspects, the geologic formation may be shale, or other rock formation that may be fractured (for example, hydraulically) prior to, or to initiate, production of hydrocarbons. The downhole heating device may be positioned in the wellbore on a tubing string or other conveyance (for example, wireline or otherwise). In some aspects, the downhole heating device is part of or coupled to a fracturing tool, and may operate prior to the tool (for example, at another depth of the wellbore relative to the fracturing operation). In some aspects, the downhole heating device is positioned in the wellbore independently of other tools, for example, prior to a fracturing operation.

Step 304 includes generating, with the downhole heating device, an amount of heat power at a specified temperature. In some aspects, the heat may be generated by a laser or microwave heat source of the downhole heating device. In alternative aspects, the heat may be generated by an in situ combustor (for example, steam combustor or otherwise). The generated heat may be focused on a particular portion of the wellbore (for example, a recently drilled portion) or may be applied to a substantial portion of the wellbore (for example, adjacent the rock formation to be fractured then produced). In some aspects, the specified temperature may be between about 400° C.-600° C. and may be a applied for a substantial duration of time, for example, thirty minutes or more. Further, in some aspects, the specified temperature may be determined based, at least in part, on a composition or property associated with the rock formation.

Step 306 includes transferring the generated heat to the geologic formation. In some aspects, heat power or temperature may be sensed or monitored in the wellbore. The sensed or monitored temperature or heat may be used, for example, at a surface or in the wellbore, to control the downhole heating device. For instance, if the sensed temperature is less than the specified temperature, the downhole heating device may be controlled to increase the heat output.

Step 308 includes adjusting a quality of the geologic formation associated with a rock strength of the geologic formation based on the generated amount of heat power at the specified temperature. For example, in some aspects, step 308 may include adjusting a Young's modulus of the rock formation (or other metric of the formation related to rock strength, rigidity, or toughness) based on applying the heat at the specified temperature to the rock formation. By adjusting (for example, reducing) a Young's modulus of the rock formation, the rock formation at the wellbore may be weakened or experience fractures, thereby allowing for easier or more efficient subsequent fracturing (for example, hydraulic).

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. As another example, although certain implementations described herein may be applicable to tubular systems (for example, drillpipe or coiled tubing), implementations may also utilize other systems, such as wireline, slickline, e-line, wired drillpipe, wired coiled tubing, and otherwise, as appropriate. As another example, some criteria, such as temperatures, pressures, and other numerical criteria are described as within a particular range or about a particular value. In some aspects, a criteria that is about a particular value is within 5-10% of that particular value. Accordingly, other implementations are within the scope of the following claims.

What is claimed is:

1. A downhole tool system, comprising:

a downhole tool string configured to couple to a downhole conveyance that extends in a wellbore from a terranean surface through at least a portion of a subterranean zone, the subterranean zone comprising a geologic formation; and a heating device coupled with the downhole tool string, the heating device rotatable for 360° about an axis to transfer heat to the geologic formation around a circumferential surface of the wellbore;

a temperature sensor positioned adjacent the heating device; and a control system communicably coupled to the temperature sensor and the heating device and configured to perform operations comprising:

controlling the heating device to operate to transfer heat to the geologic formation in the wellbore at a specified temperature between 400° C. and 600° C. and a specified time duration between 30 minutes and an hour to reduce a static Young's modulus of the geologic formation to generate one or more fractures in the geologic formation;

receiving a temperature value from the temperature sensor; and adjust the heating device based, at least in part, on the received temperature value.

2. The downhole tool system of claim 1, wherein the geologic formation comprises a shale formation.

3. The downhole tool system of claim 2, wherein the heating device comprises at least one of a microwave heating device, a laser heating device, or an in situ combustor.

4. The downhole tool system of claim 2, wherein the control system comprises one or more micro-processors.

5. The downhole tool system of claim 2, wherein the operations further comprise controlling the heating device to focus the heat on a portion of the geologic formation on the circumferential surface of the wellbore.

6. The downhole tool system of claim 1, wherein the heating device comprises at least one of a microwave heating device, a laser heating device, or an in situ combustor.

7. The downhole tool system of claim 6, wherein the operations further comprise:

determining that the transferred heat is at a temperature higher than the specified temperature; and based on the determination, controlling the heating device to output a reduced heat.

8. The downhole tool system of claim 1, wherein the control system comprises one or more micro-processors.

9. The downhole tool system of claim 8, wherein the operations further comprise:

determining that the transferred heat is at a temperature higher than the specified temperature; and based on the determination, controlling the heating device to output a reduced heat.

10. The downhole tool system of claim 1, wherein the operations further comprise controlling the heating device to focus the heat on a portion of the geologic formation on the circumferential surface of the wellbore.

11. The downhole tool system of claim 1, further comprising a top sub-assembly configured to couple the heating device to the downhole conveyance.

12. The downhole tool system of claim 1, further comprising a housing that at least partially encloses the heating device, the housing connected to the top sub-assembly.

13. The downhole tool system of claim 12, further comprising a bottom sub-assembly connected to the housing and configured to couple to a hydraulic fracturing tool.

14. The downhole tool system of claim 13, wherein the heating device comprises at least one of a microwave heating device, a laser heating device, or an in situ combustor.

15. The downhole tool system of claim 1, wherein the specified temperature is between 400° C. and 500° C.

16. The downhole tool system of claim 15, wherein the heating device comprises at least one of a microwave heating device, a laser heating device, or an in situ combustor.

17. The downhole tool system of claim 1, further comprising a bottom sub-assembly configured to couple to a hydraulic fracturing tool.

18. The downhole tool system of claim 1, wherein the operation of receiving a temperature value from the temperature sensor comprises receiving a semi-continual stream of temperature values from the temperature sensor.

19. The downhole tool system of claim 1, wherein the operation of receiving a temperature value from the temperature sensor comprises receiving a continual stream of temperature values from the temperature sensor.

20. The downhole tool system of claim 1, wherein the operations further comprise:

determining that the transferred heat is at a temperature higher than the specified temperature; and based on the determination, controlling the heating device to output a reduced heat.

* * * * *